US006286409B1

(12) United States Patent
Na et al.

(10) Patent No.: US 6,286,409 B1
(45) Date of Patent: Sep. 11, 2001

(54) APPARATUS FOR RESTRAINING AND RELEASING MISSILE USING RIGID SPHERE

(75) Inventors: Moon Soo Na; Yeol Wha Lee; Tae Hak Park; Heung Joon Park, all of Daejon (KR)

(73) Assignee: Agency for Defense Development, Daejon (KR)

( * ) Notice: Subject to any disclaimer, the term of this patent is extended or adjusted under 35 U.S.C. 154(b) by 0 days.

(21) Appl. No.: 09/296,719

(22) Filed: Apr. 22, 1999

(30) Foreign Application Priority Data

Dec. 8, 1998 (KR) ..... 98-53763

(51) Int. Cl.[7] ..... F41F 3/04
(52) U.S. Cl. ..... 89/1.806
(58) Field of Search ..... 89/1.8, 1.806, 89/1.812

(56) References Cited

U.S. PATENT DOCUMENTS

| | | | | |
|---|---|---|---|---|
| 3,444,773 | * | 5/1969 | Ligne | 85/9 |
| 4,453,449 | * | 6/1984 | Hollmann | 89/1.806 |
| 4,550,640 | * | 11/1985 | Harter | 89/1.806 |
| 5,056,407 | * | 10/1991 | Mathey | 89/1.806 |
| 5,714,708 | * | 2/1998 | Shim et al. | 89/1.806 |
| 5,744,745 | * | 4/1998 | Shim et al. | 89/1.806 |

FOREIGN PATENT DOCUMENTS

1428642 * 12/1964 (DE) .

1340562 * 12/1962 (FR) .

* cited by examiner

*Primary Examiner*—Michael J. Carone
*Assistant Examiner*—Kyonyaek K. Mun
(74) *Attorney, Agent, or Firm*—Scully, Scott, Murphy & Presser

(57) ABSTRACT

An apparatus for restraining and releasing a missile using a rigid sphere is disclosed. The apparatus includes a pair of circular restraining protrusions formed at a rear end portion of a missile nozzle portion, a missile side restraining and releasing means having an operation cylinder engaged to a rear end surface of the restraining protrusion of the missile, an operation piston reciprocating within the operation cylinder, and a rigid sphere protruded from an outer surface of the operation cylinder when the operation piston is moved back and inserted into the outer surface of the operation cylinder when the operation piston is moved forwardly, a canister side restraining and releasing means having a missile restraining portion fixed to the inner surface of the rear end portion of the canister into which the missile is inserted, with the circular restraining protrusion being inserted into the missile restraining portion, a fixing cylinder fixing portion into which the rigid sphere protruded from the outer surface of the operation cylinder is inserted, and a piston guide portion for guiding the rear end portion of the operation piston, and a combustion gas guide means for guiding a part of a combustion gas generated when launching the missile toward the rear end portion of the operation piston for thereby moving the operation piston forwardly, so that the rigid sphere is escaped from the rigid sphere restraining groove.

24 Claims, 9 Drawing Sheets

APPARATUS FOR RESTRAINING AND RELEASING MISSILE USING RIGID SPHERE

BACKGROUND OF THE INVENTION

1. Field of the Invention

The present invention relates to an apparatus for restraining and releasing a missile using a rigid sphere, and in particular to an improved apparatus for restraining and releasing a missile using a rigid sphere which is capable of implementing a stable and accurate restraining of a missile and quickly releasing the missile without any impact or vibration when launching the missile.

2. Description of the Conventional Art

Generally, when moving a missile, the missile is inserted into a canister(launch tube) and supported thereby for protecting the missile from any external environment such as impact or vibration. When launching the missile, the missile is released from the restrained state. In this case, it is very important to stably insert the missile into the canister(launch tube), restrain the same and release the missile. When moving the missile, the missile is stably restrained by the canister with respect to an external force. When launching the missile, the missile restrained in the canister is quickly and accurately released for thereby enabling a reliability of the missile launching system.

In the conventional art, various missile restraining apparatuses are used. For example, an explosion type is directed to restraining a missile using an explosive bolt with an explosive therein and exploding the explosive bolt before launching the missile, and a tension or shear bolt type is directed to restraining a missile using a tension or shear bolt and releasing the missile by breaking the tension bolt or shear bolt using a launching force of the missile.

In the case of the launching type, an explosive force may damage a building or the interior of the missile. In the state the explosive bolt is not exploded, when a missile is launched, since the missile is launched with the canister being engaged, it is needed to check whether the explosive bolt is exploded before the missile is launched for preventing the above-described problems.

In the tension bolt or shear bolt type, the tension bolt or shear bolt is broken when the launching force exceeds the tension force of the tension bolt or the shearing force of the shear bolt. Since the tension force of the tension bolt or the shearing force of the shear bolt is affected by an initial acceleration of the launching force, in the case of the missile having a small launching force, the bolt having a small tension force or shear force is used, so that the reliability of the missile system is decreased the tension or shear bolt may be easily broken when handling the missile and the canister. On the contrary, in the case of the missile having a large launching force, since the bolt having a large tension force or shearing force is used, the bolts may not be broken when launching the missile, so that the impact force applied to the canister is increased for thereby causing a vibration of the canister and missile, and thus the missile may not be normally controlled.

The explosive type or the tension bolt or shear bolt type are all directed to a material exploding and breaking type, so that an exploding portion or breaking portion is broken by an over stress. Therefore, when fabricating the explosive, tension, or shear bolt, it is needed to maintain a uniformity in the quality of the material of the same and check a predetermined defect therein in order for the explosive, tension, or shear bolt to have a predetermined breaking force, tension or shearing force.

In addition, the conventional apparatus has a problem in that a predetermined error may occur when launching the missile due to the above-described problems.

SUMMARY OF THE INVENTION

Accordingly, it is an object of the present invention to provide an apparatus for restraining and releasing a missile using a rigid sphere which overcomes the aforementioned problems encountered in the conventional art.

It is another object of the present invention to provide an apparatus for restraining and releasing a missile using a rigid sphere which is capable of implementing a stable restraining of a missile, quickly and accurately restraining the missile from its restrained state using a combustion gas of a rocket motor of the missile for thereby preventing a vibration of a launching bed due to an external impact and increasing a launching stability and minimizing a launching error.

To achieve the above objects, there is provided an apparatus for restraining and releasing a missile using a rigid sphere which includes a pair of circular restraining protrusions formed at a rear end portion of a missile nozzle portion, a missile side restraining and releasing means having an operation cylinder engaged to a rear end surface of the restraining protrusion of the missile, an operation piston reciprocating within the operation cylinder, and a rigid sphere protruded from an outer surface of the operation cylinder when the operation piston is moved back and inserted into the outer surface of the operation cylinder when the operation piston is moved forwardly, a canister(launch tube) side restraining and releasing means having a missile restraining portion fixed to the inner surface of the rear end portion of the canister into which the missile is inserted, with the circular restraining protrusion being inserted into the missile restraining portion, a fixing cylinder fixing portion into which the rigid sphere protruded from the outer surface of the operation cylinder is inserted, and a piston guide portion for guiding the rear end portion of the operation piston, and a combustion gas guide means for guiding a part of a combustion gas generated when launching the missile toward the rear end portion of the operation piston for thereby moving the operation piston forwardly, so that the rigid sphere is escaped from the rigid sphere restraining groove for thereby releasing the restrained state of the missile.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The embodiments of an apparatus for restraining a missile and releasing the same using a rigid sphere according to the present invention will be explained with reference to the accompanying drawings.

Figure 1:
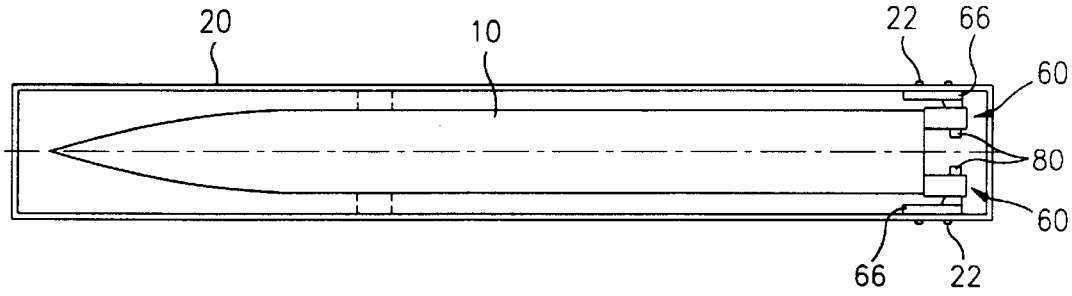
FIG. 1 is a horizontal cross-sectional view illustrating an assembled state of a missile and a canister(launch tube) adapting an apparatus for restraining and releasing a missile according to the present invention.
Figure 2:
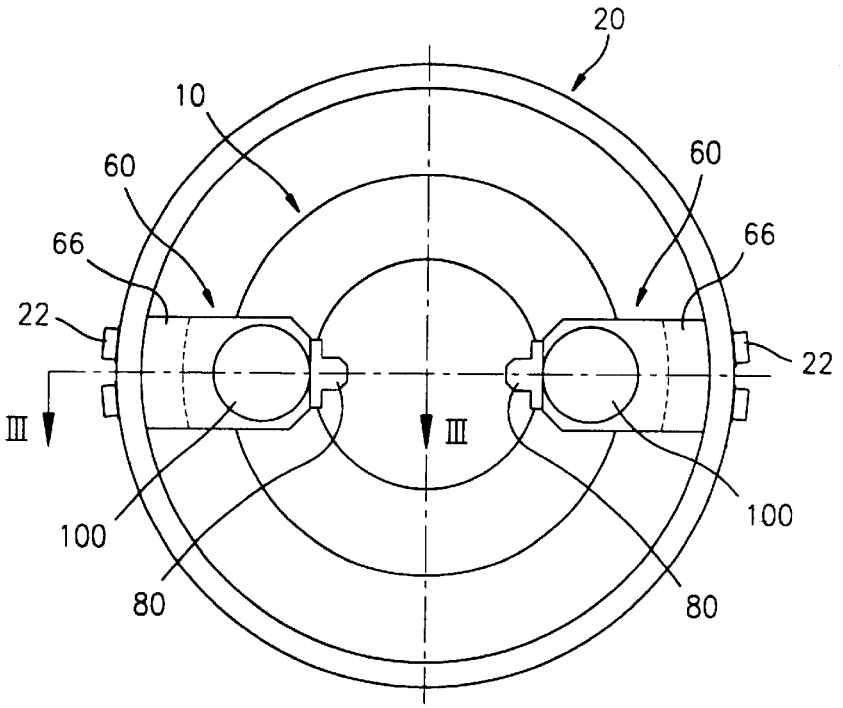
FIG. 2 is a side view of FIG. 2.

FIG. 1 is a horizontal cross-sectional view illustrating an assembled state of a missile and a canister(launch tube) adapting an apparatus for restraining and releasing a missile according to the present invention, and FIG. 2 is a side view of FIG. 2. In the drawings, reference numeral 10 represent a missile, and 20 represents a canister(launch tube). The missile 10 is restrained by a restraining and releasing member in the canister 20.

As shown FIGS. 1 through 5, the missile 10 is inserted into the interior of the canister 20. A nozzle 11 of a rocket motor provided at the end portion is fixed by the restraining and releasing member.

A pair of circular restraining protrusions 12 are protrudely formed on an end portion surface of the nozzle 11, and a restraining screw groove 13 is formed at the center portion of the restraining protrusions 12.

Figure 3:
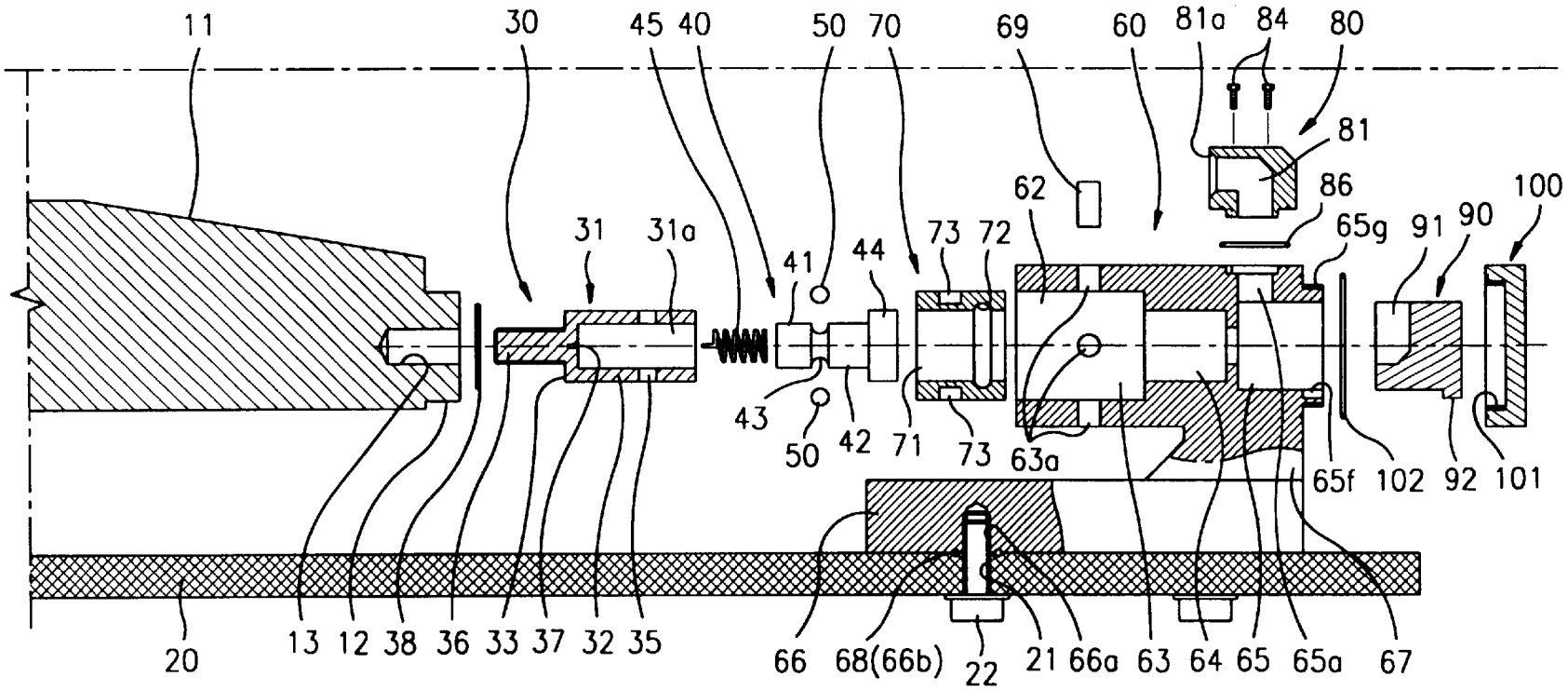
FIG. 3 is an exploded cross-sectional view taken along the line III—III of FIG. 2.
Figure 4A:
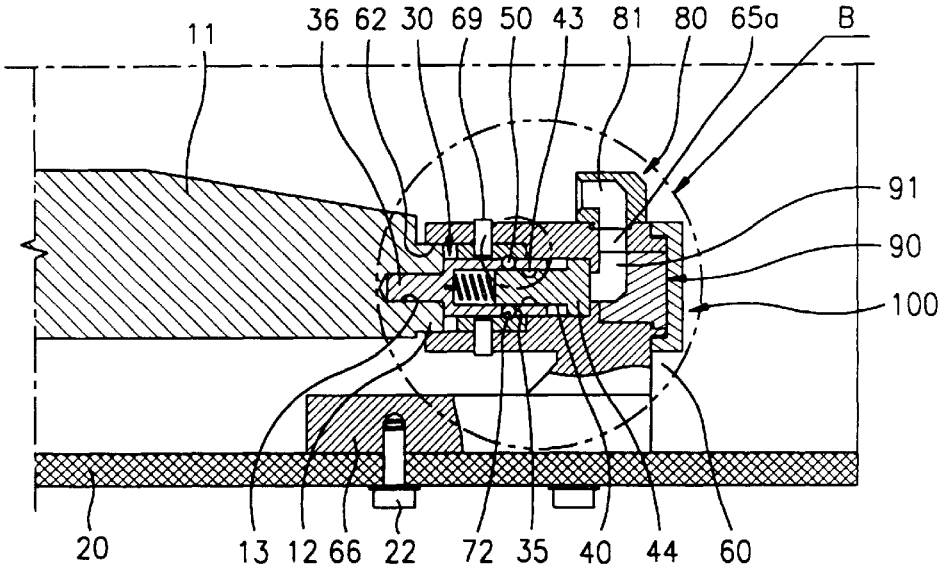
FIG. 4A is a partial cross-sectional view illustrating a state that a missile is restrained in a canister according to the present invention.

As shown in FIG. 1, the canister 20 is cylindrical and hollow and has an inner diameter larger than the outer diameter of the missile 10. As shown in FIGS. 3 and 4C, a screw through hole 21 into which a fixing screw 22 is inserted for fixing the restraining and releasing member is formed on the wall of the canister 20.

The restraining and releasing member is formed of a missile side restraining and releasing member fixed to the missile 10 and a canister side restraining and releasing member fixed to the canister 20.

Figure 5:
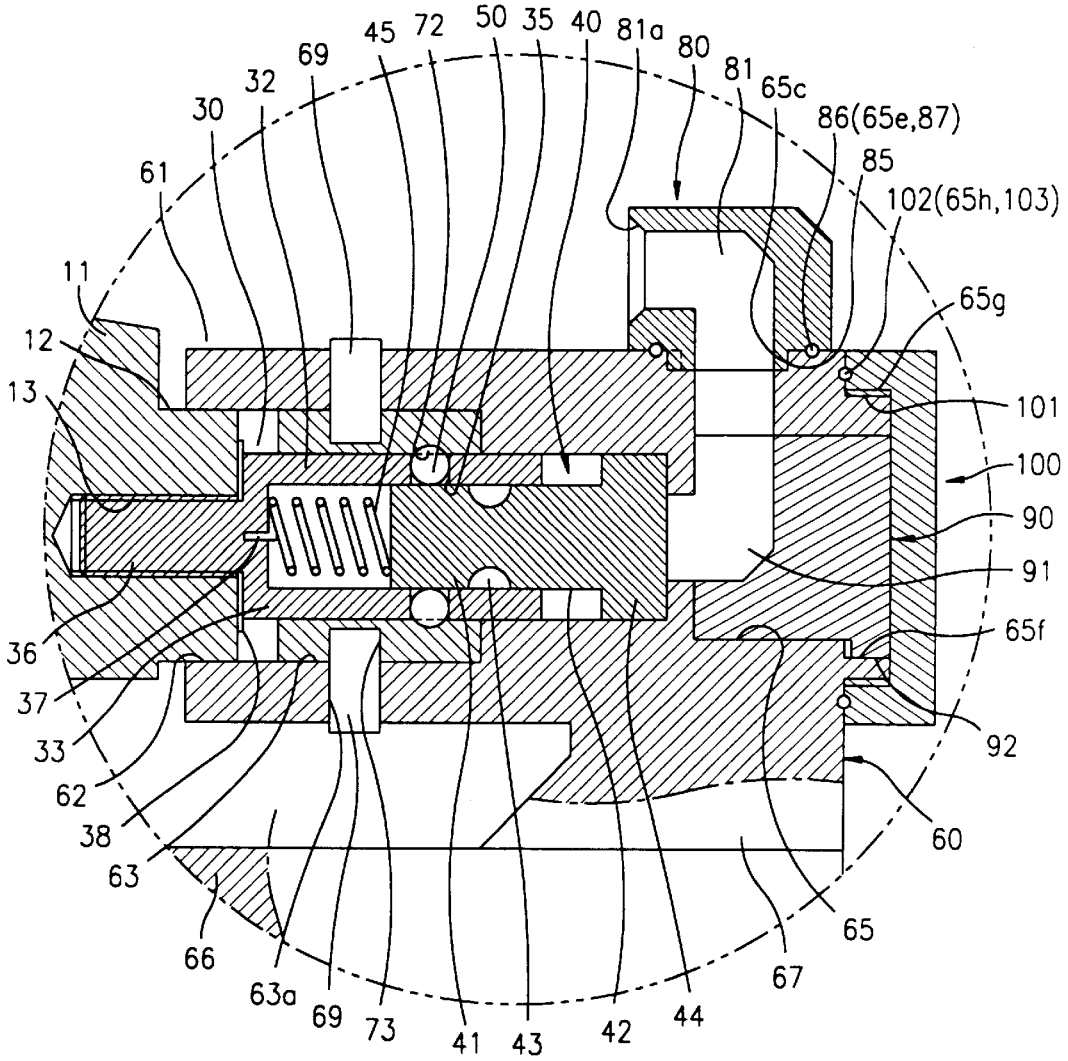
FIG. 5 is an enlarger view illustrating the portion B of FIG. 4A.

As shown in FIGS. 2 and 5, the missile side restraining and releasing member includes an operation cylinder 30 fixed to an end portion of the restraining protrusion of the missile 10, an operation piston 40 reciprocating within the operation cylinder 30, and a rigid sphere 50 protruded from the outer surface of the operation cylinder 40 when the operation piston 40 is moved back and inserted into the interior of the outer surface of the operation cylinder 30 when the operation piston 40 is forwardly moved.

As shown in FIGS. 3 through 6, the operation cylinder 30 includes an operation portion 31 having an operation space 31*a* connected with the end portion of the restraining protrusion 12 and having its opened rear portion and a rigid sphere hole 35 formed on the wall 32 into which the rigid sphere 50 is inserted.

As shown in FIGS. 3 through 5 and 7B, the operation piston 40 includes a restraining operation portion 41 for maintaining a part of the rigid sphere 50 which is protruded from the right sphere hole 35 when the operation piston 40 is moved back in the operation cylinder 30, and a restraining release operation groove 43 into which the remaining portions of the rigid sphere 50 inserted into the rigid sphere hole are inserted when the operation piston 40 is forwardly moved.

The operation portion 31 of the operation cylinder 30 has its rear portion opened by the wall 32 and the front wall 33 for thereby forming a piston operation space 31*a* with its front side being blocked.

A threaded rod 36 is integrally extended from the front wall 33, and the threaded rod 36 is engaged with the restraining screw groove 13 formed in the center portion of the restraining protrusion 12 for thereby fixing the operation cylinder to the end portion of the missile 10.

A tool groove 37 is formed on the inner surface of the front wall 33 of the operation cylinder 30 for inserting a predetermined tool such as a driver or wrench used for engaging the threaded rod 36 to the restraining screw groove 13. In this embodiment, the tool groove 37 is formed for a flat head driver. Preferably, the tool groove 37 may be formed for a cross head driver. More preferably, the tool groove 37 may be formed for a rectangular or hexagonal head wrench.

Figure 6A:
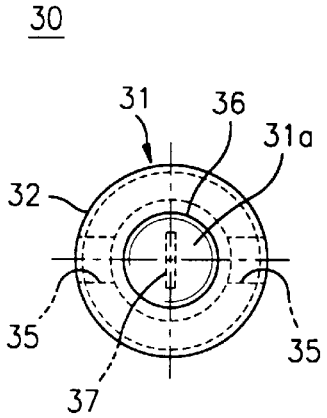
FIGS. 6A and 6B are front and side views illustrating an operation cylinder.
Figure 6B:
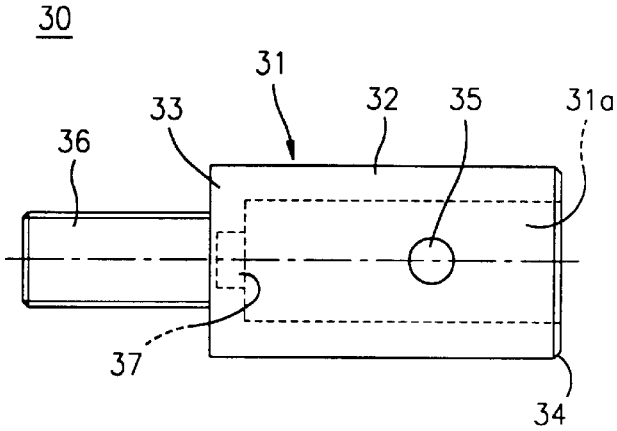
Figure 7A:
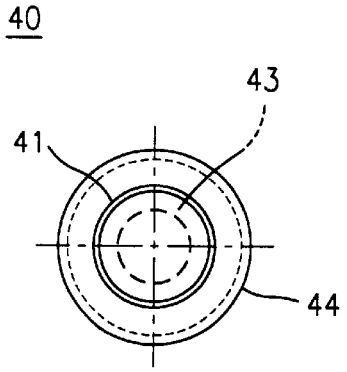
FIGS. 7A and 7B are front and side views illustrating an operation piston.
Figure 7B:
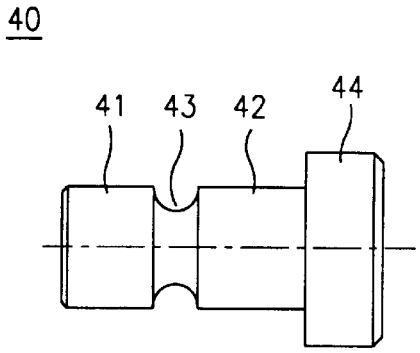
Figure 8A:
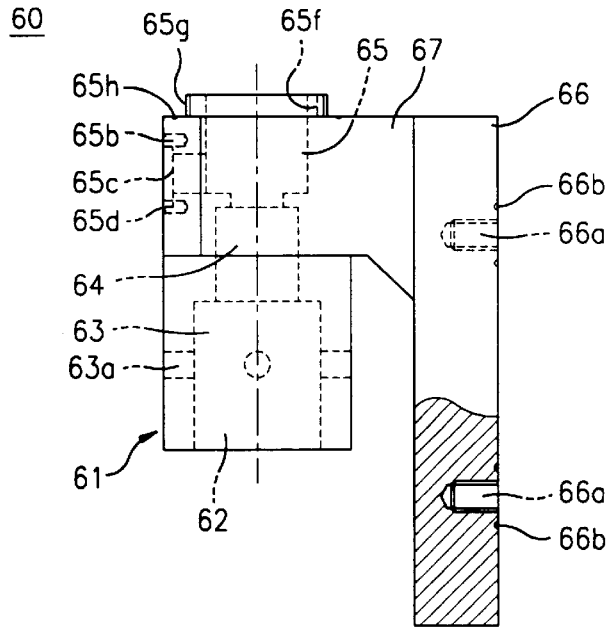
FIGS. 8A, 8B and 8C are plan, side and front views illustrating a fixing member.
Figure 8B:
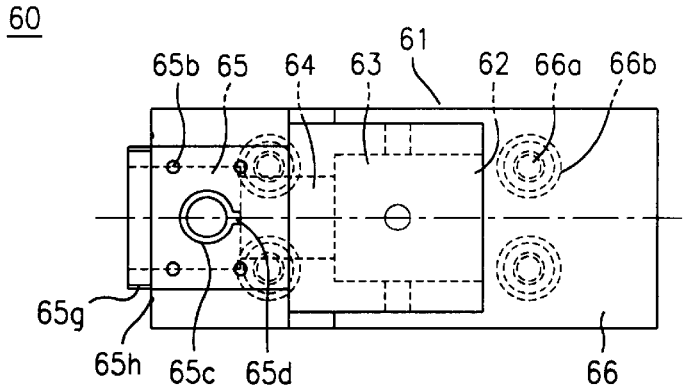
Figure 8C:
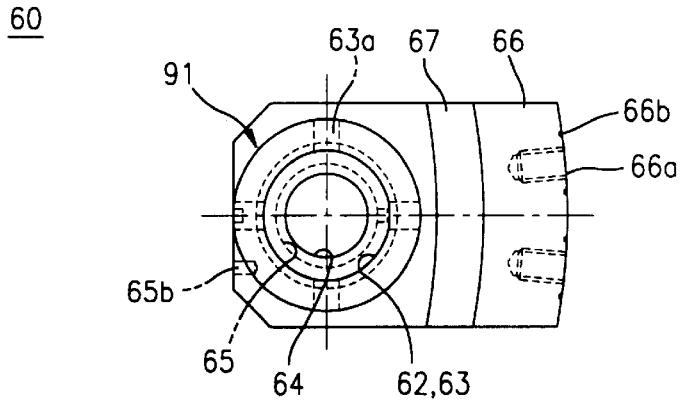
Figure 9A:
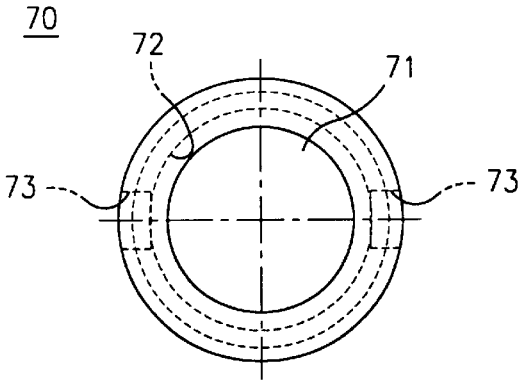
FIGS. 9A and 9B are front and side views illustrating a fixing cylinder.
Figure 9B:
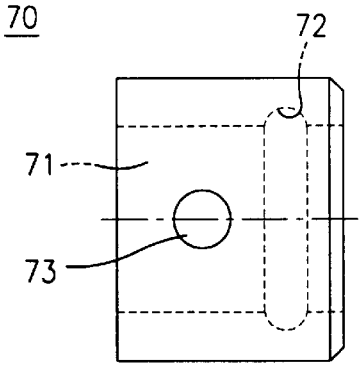
Figure 10A:
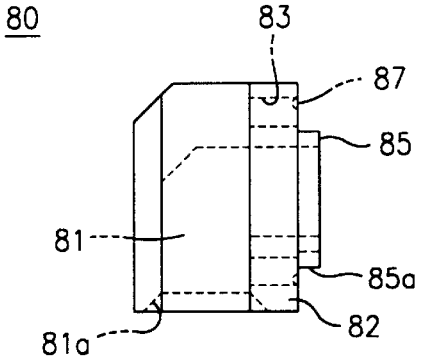
FIGS. 10A, 10B and 10C are plan, front and side views illustrating a combustion gas inlet member.
Figure 10B:
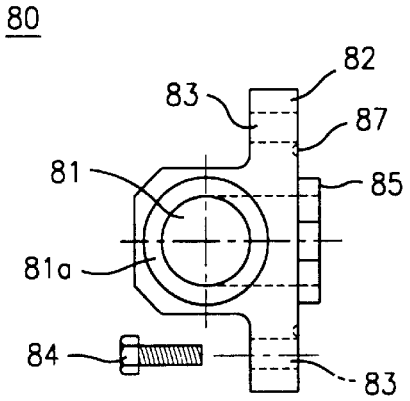
Figure 10C:
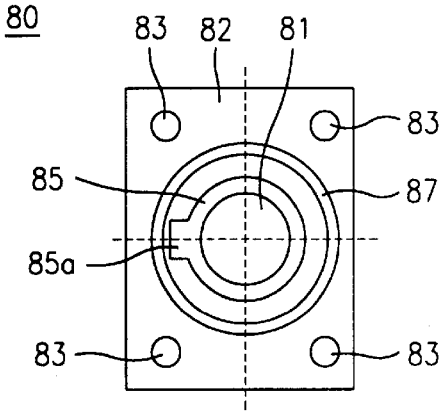
Figure 11A:
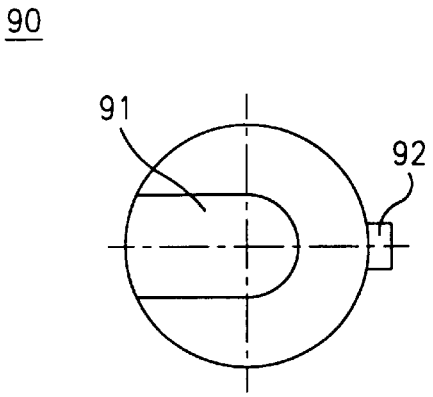
FIGS. 11A and 11B are front and bottom views illustrating a combustion gas guide member.
Figure 11B:
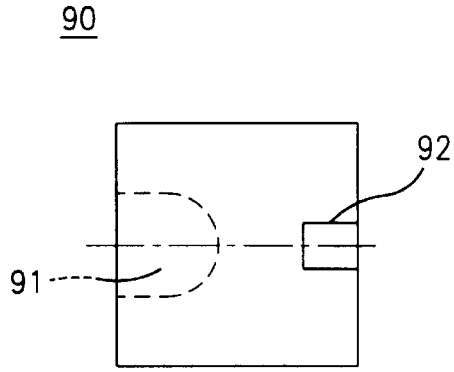
Figure 12A:
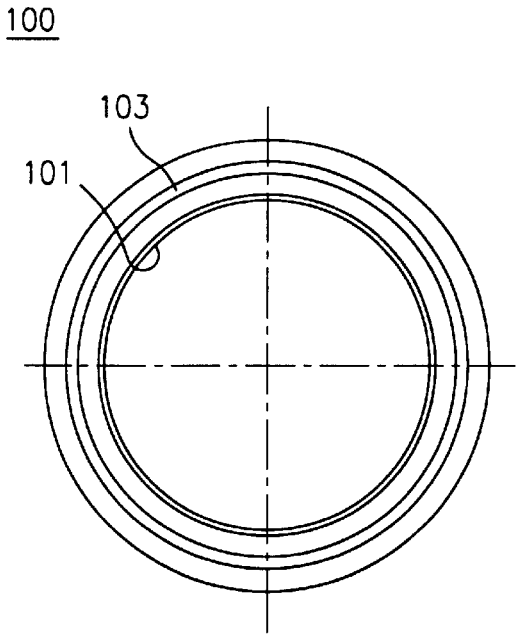
FIGS. 12A and 12B are front and side views illustrating a final fixing member.
Figure 12B:
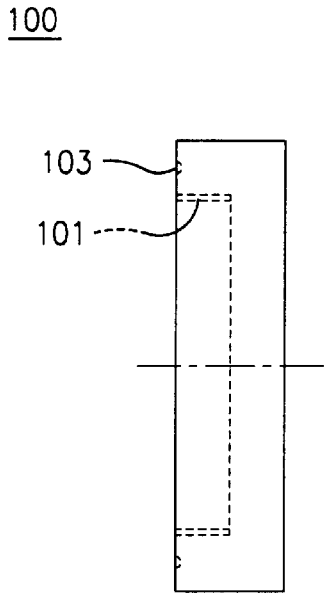

In FIG. 6*b*, reference numeral 34 represents a rear side of the operation cylinder 30, and in FIGS. 3 and 5, reference numeral 38 represents a washer inserted between the restraining protrusion 12 and the operation cylinder 30.

The operation piston 40 includes an integral guide portion 42 contacting with the inner surface of the piston operation space 31*a* of the operation cylinder 30 in the direction of the rear portion of the restraining release operation groove 43 for implementing a smooth reciprocating operation of the operation piston 40 in the operation cylinder 30.

In addition, the operation piston 40 may be designed so that the combustion gas which is generated when launching a missile and guided by the combustion gas guide member is directly applied to the rear end portion of the guide portion 42. A rear end expanding portion 44 is formed at the rear end portion of the guide portion 42 so that the rigid sphere 50 is smoothly moved in the restraining release operation groove 43 for accurately matching the rigid sphere hole 35 and the restraining release operation groove 43 when the operation piston 40 is forwardly moved by the combustion gas.

The operation piston 40 is elastically supported in the direction of the rear end of the same by an elastic member 45 such as a compression coil spring inserted between the front surface of the restraining operation portion 41 and the inner surface of the front wall 33 of the operation cylinder 30 in the piston operation space 31*a* of the operation cylinder.

The rigid sphere 50 has a predetermined strength and hardness similar to the rigid property and is a full circular ball shape. As shown in FIGS. 4A and 5, the rigid sphere 50 is inserted into the rigid sphere hole 35 of the operation cylinder 30. The rigid sphere 50 is upwardly supported by the restraining operation portion 41 when the restraining operation portion 41 is positioned at the position of the rigid sphere hole 35 when the operation piston 40 is moved back, so that the rigid sphere 50 is protruded from the wall 32 of the operation cylinder 30 through the rigid sphere hole 35 in a state that the center of the same is positioned within the rigid sphere hole 35, and when the operation piston 40 is moved forwardly, and the restraining release operation groove 43 is positioned at the position of the rigid sphere hole 35, the rigid sphere 50 is fully inserted into the rigid sphere hole 35 and the restraining release operation groove 43, so that the rigid sphere 50 is not protruded from the outer surface of the operation portion 31 of the operation cylinder 30.

As shown in FIG. 4C, assuming that the diameter of the rigid sphere 50 is D, the thickness of the wall 32 of the operation cylinder 30 is t, the depth of the restraining release operation groove 43 is d, and the depth of the rigid sphere restraining groove 72 of the fixing cylinder 70 is d', the following expression may be obtained.

$$D \leqq t+d,\ D=t+d',\ D/2<t \text{ and } D/2>d$$

As shown in FIGS. 3 through 5 and 8A through 8C, the canister side restraining and releasing member includes a fixing member 60. The fixing member 60 includes a missile restraining portion 62 fixed to both sides of the inner surface of the end portion of the canister 20 and having a front portion into which the restraining protrusion 12 is inserted, a fixing cylinder fixing portion 63 into which the fixing cylinder 70 restraining the rigid sphere 50 protruded from the outer surface of the operation cylinder 30 is inserted, a piston guide portion 64 guiding the rear portion of the operation piston 40 and a restraining and releasing operation portion 61 in which the combustion gas inlet portion 65 having a combustion gas guide member is coaxially formed in the forward and rearward directions.

In the fixing member 60, the fixing portion 66 for fixing the same to the inner surface of the canister 20 is integrally formed through the connection support portion 67.

The fixing portion 66 is formed in a curved shape which is the same as the inner surface of the canister 20 to be closely contacted with the inner surface of the canister 20 and has a screw groove 66*a* engaged with the fixing screw 22 inserted into the screw through hole 21 formed in the canister 20.

An O-ring 68 is inserted between the inner surface of the canister 20 and the fixing portion 66 for maintaining a sealed state therebetween. An O-ring groove 66*b* into which the O-ring 68 is inserted is formed at a portion around the screw groove 66*a* of the fixing portion 66, so that the O-ring 68 is not moved when engaging the fixing screw 22. As shown in FIG. 3, the O-ring groove 66*b* and the O-ring 68 are seen at the same position.

The missile restraining portion 62 has a predetermined margin for stably restraining the missile in order to implement a smooth insertion and escape of the restraining protrusion 12 of the missile 10.

Th fixing cylinder 70 formed along the inner surface of the rigid sphere restraining groove 72 into which the rigid sphere 50 is inserted into the fixing cylinder fixing portion 63.

As shown in FIGS. 3 through 5 and 9A and 9B, the fixing cylinder 70 is formed in a cylindrical form having a piston operation space 71 with its both ends being opened, and the rigid sphere restraining groove 72 is formed along the entire inner surfaces.

The inner diameter of the fixing cylinder 70 is slightly larger than the outer diameter of the operation cylinder 30, so that the operation cylinder 30 is movable in the operation space 71.

The fixing cylinder 70 having the rigid sphere restraining groove 72 is formed in the fixing cylinder fixing portion 63, and the rigid sphere 50 is inserted into the rigid sphere restraining groove 72. Preferably, the rigid sphere restraining groove 72 may be directly formed on the inner surface of the fixing cylinder fixing portion 63.

A plurality of pin through holes 63*a* through which the fixing pins 69 pass are formed on the wall of the fixing cylinder fixing portion 63 for fixing the fixing cylinder 70, and a plurality of pin fixing holes 73 corresponding to the pin through holes 63*a* are formed on the wall of the fixing cylinder 70, so that the fixing pins 69 are inserted into the pin fixing grooves 73 through the pin through holes 63*a* for thereby fixing the fixing cylinder 70 to the fixing cylinder fixing portion 63.

The piston guide portion 64 is formed to have a predetermined fitting margin, so that the rear end expanding portion 44 of the operation piston 40 become movable smoothly.

In addition, the fitting margin between the piston guide portion 64 and the rear end expanding portion 44 is set to minimize the leakage of the gas between the inner surface of the piston guide portion 64 and the outer surface of the rear end expanding portion 44 when the pressure of the missile combustion gas guided by the combustion gas guide member is applied to the rear end expanding portion 44.

The combustion gas inlet portion 65 is a portion at which the combustion gas guide member is mounted and has a combustion gas inlet hole 65*a* formed on its outer wall.

A screw groove 65*b* is formed at a portion around the combustion gas inlet hole 65*a* of the combustion gas inlet portion 65 for fixing elements(gas inlet members) of the combustion gas guide member.

An assembling groove 65*c* and a key guide groove 65*d* are formed at an outer edge portion of the combustion gas inlet hole 65*a* for accurately engaging the elements(gas inlet members) of the combustion gas guide member.

An O-ring groove 65*e* is formed at a portion around the assembling groove 65*c*. In FIG. 5, the O-ring groove 65*e* and the O-ring 86 are seen at the same position.

A key guide groove 65*f* is formed on an outer circumferential surface of the combustion gas inlet portion 65 for accurately engaging the elements(gas guide members) of the combustion gas guide member inserted into the interior of the same.

A threaded portion 65*g* is formed at a rear end portion of the combustion gas inlet portion 65 for engaging the elements(final fixing member) fixing the elements(gas guide member) of the combustion gas guide member.

An O-ring groove 65*h* is formed on a rear end surface of the threaded portion 65*g*. In FIG. 5, the O-ring groove 65*h* and the O-ring 102 are seen at the same position.

The combustion gas guide member includes a combustion gas inlet member 80 having a combustion gas inlet hole 81 for flowing a missile combustion gas into the combustion gas inlet hole 65*a*, and a combustion gas guide member 90 installed in the interior of the combustion gas inlet portion 65 and having a combustion gas guide hole 91 for guiding the missile combustion gas flown into the combustion gas inlet hole 65*a* to the forward portion of the interior of the restraining and releasing operation portion 61.

The combustion gas inlet hole 81 is formed in a curved shape(inverted L-shape) and has its one end opened toward the forward side, and its another end connected with the combustion gas inlet hole 65*a*.

In addition, a conical combustion gas inlet 81*a* is formed at the front end portion of the combustion gas inlet hole 81 for thereby enabling a smooth introduction of the missile combustion gas.

A flange portion 82 closely contacting with the outer circumferential surface of the combustion gas inlet portion 65 is formed in the inner portion of the combustion gas inlet member 80, and a plurality of screw through holes 83(in the drawings, four screw through holes are seen) are formed in the flange portion 82. The combustion gas inlet member 80 is fixed to the outer portion of the combustion gas inlet portion 65 of the fixing member 60 in such a manner that the fixing screw 84 passing through the screw through hole 83 is engaged with the screw groove 65*b* formed on the outer circumferential surface of the combustion gas inlet portion 65.

An assembling protrusion 85 is formed in the inner side of the combustion gas inlet member 80, and a guide key 85*a* is formed on an outer surface of the assembling protrusion, and the combustion gas inlet 81*a* of the combustion gas inlet hole 81 of the combustion gas inlet member 80 is forwardly installed in such a manner that the assembling protrusion 85 is inserted into the assembling groove 65*c* and the guide key 85*a* is arranged with the key guide groove 65*d*, so that the inner end is accurately arranged with the combustion gas inlet hole 65*a*. The combustion gas inlet hole 81 passes through the assembling protrusion 85. Here, the assembling protrusion 85 is formed a ring shape.

An O-ring 86 is inserted between the outer surface of the combustion gas inlet portion 65 and the combustion gas inlet member 80. O-ring grooves 65*e* and 87 are formed at an outer edge portion of the combustion gas inlet hole 65*a* of the combustion gas inlet portion 65 and the flange portion 82 of the inlet member 80, respectively.

The combustion gas guide hole 91 of the combustion gas guide member 90 is formed a curved shape(L-shape) with its one end being arranged with the inner end of the combustion gas inlet hole 65*a*, and its another end being forwardly curved.

A guide key 91 is protruded from the combustion gas guide member 90, and the combustion gas guide member 90 is inserted into the combustion gas inlet portion 65 in a state that the guide key 92 is arranged with the key guide groove 65*f*, so that one end of the combustion gas guide hole 91 is accurately arranged with the inner end of the combustion gas inlet hole 65*a*.

The combustion gas guide member 90 may be tightly inserted into the interior of the combustion gas inlet portion 65. Preferably, the same may be fixed by the final fixing member 100.

The final fixing member 100 is formed like a shallow dish, and a threaded portion 101 engaged with the threaded portion 65*g* formed at the rear end portion of the combustion gas inlet portion 65 is formed on an inner surface of the same, and the escape of the combustion gas guide member 90 is prevented by engaging the threaded portions 65*g* and 101.

An O-ring 102 is inserted between the rear end portion of the combustion gas inlet portion 65 and the final fixing member 100. O-ring grooves 95*h* and 103 are formed on the rear end surface of the combustion gas inlet portion 65 and on the front surface of the final fixing member 100.

The assembling process of the missile restraining and releasing apparatus using a rigid sphere according to the present invention will be explained with reference to the accompanying drawings.

The missile side restraining and releasing member is engaged with the missile 10, and the canister side restraining and releasing member is engaged with the canister 20.

Figure 4B:
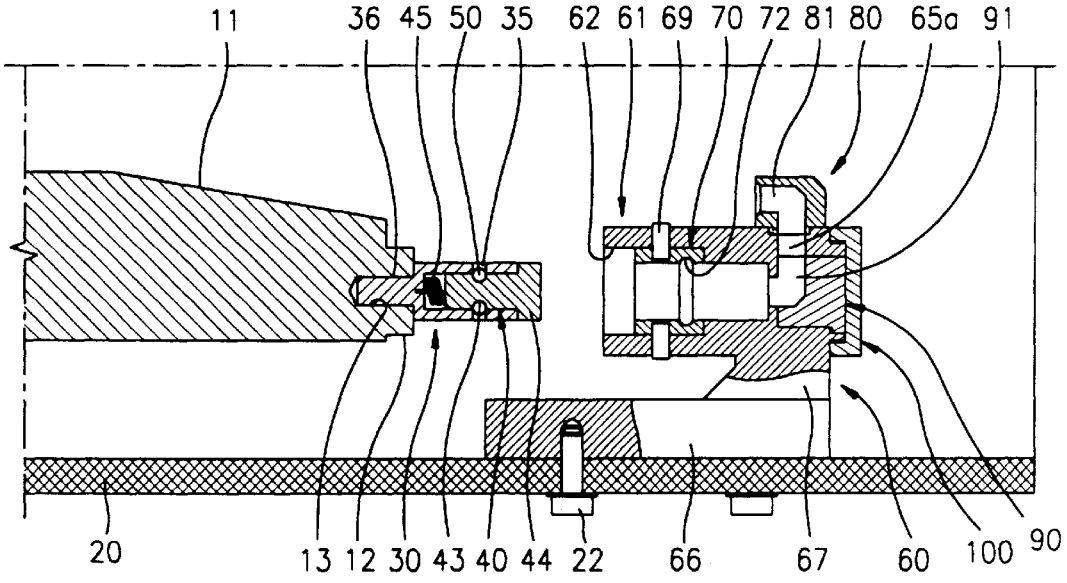
FIG. 4B is a partial cross-sectional view illustrating a state that a missile is released from a canister according to the present invention.
Figure 4C:
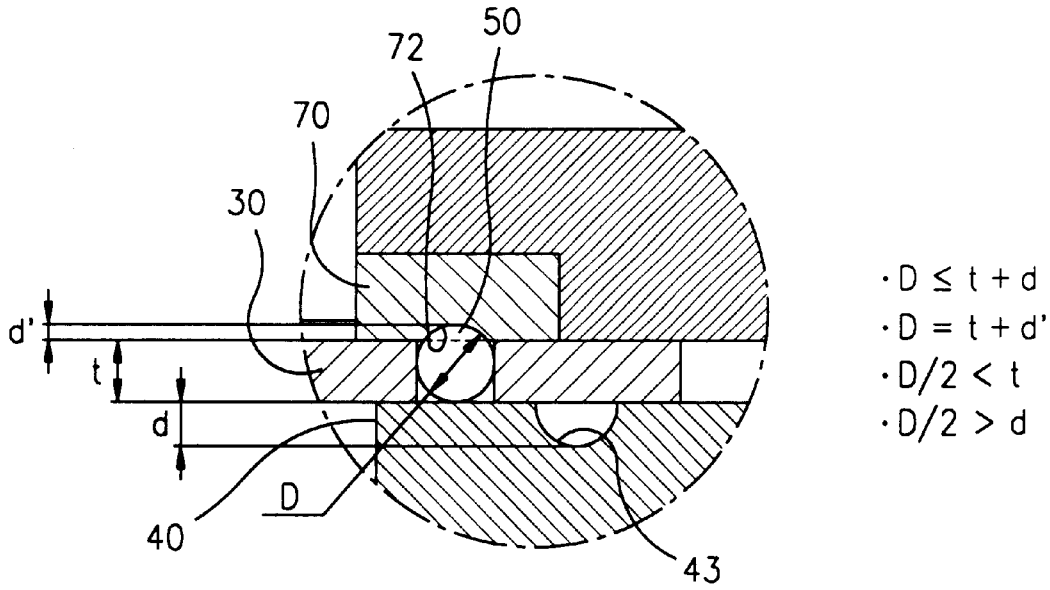
FIG. 4C is a partially exploded view of FIG. 4A illustrating an optation cylinder, an operation piston and a rigid sphere according to the present invention.

When engaging the missile side restraining and releasing member, the missile 10 is fixed to the operation cylinder 30 in such a manner that the threaded rod 36 is engaged with the restraining screw groove 13 formed at the restraining protrusion 12 of the missile 10 as shown in FIG. 4B. At this time, the operation cylinder 30 is easily engaged with the restraining protrusion 12 in such a manner that a tool such as a driver or wrench is inserted into the tool groove 37 formed on the inner surface of the front wall 33.

Next, the elastic member 45 is inserted into the piston operation space 31 a of the operation cylinder 30 fixed to the restraining protrusion 12, and then the operation piston 40 is inserted, and the rigid sphere 50 is inserted into the rigid sphere hole 35. At this time, as shown in FIG. 4B, in the assembling state of the missile side restraining and releasing member, a part of the rigid sphere 50 is inserted into the rigid sphere hole 35 through the rigid sphere hole 35, and the remaining parts of the same is inserted into the restraining release operation groove 43 of the operation piston 40 in a state that the elastic member 45 is compressed so that the front surface of the rear end expanding portion 44 of the operation piston 40 closely contacts with the rear end surface 34 of the operation cylinder 30, whereby the rigid sphere 50 is not protruded from the outer surface of the operation cylinder 30.

The above-described assembling processes are performed in a state that a predetermined lubricant is applied on the surfaces of the restraining operation unit 41 of the operation piston 40 and the inner surfaces of the guide portion 42 and the piston operation space 31*a* of the operation cylinder 30 for thereby implementing a smooth movement of the operation piston 40 within the operation cylinder 30.

When assembling the canister side restraining and releasing member, the fixing cylinder 70 is inserted into the fixing cylinder fixing portion 63 of the fixing member 60, and the fixing pin 69 is inserted into the pin through hole 63*a* formed on the wall of the fixing cylinder fixing portion 63, and the inner end portion is inserted into the pin fixing groove 73 formed on the wall of the fixing cylinder 70, so that the fixing cylinder 70 is fixed to the fixing cylinder fixing portion 63 as shown in FIGS. 4A and 5.

The assembling protrusion 85 of the combustion gas inlet member 80 is inserted into the assembling groove 65*c* formed on the outer surface of the combustion gas inlet portion 65 from the outer side of the combustion gas inlet portion 65 of the fixing member 60 fixed with the fixing cylinder 70, and the screw through hole 83 of the flange portion 82 is arranged with the screw groove 65*b* formed on the outer surface of the combustion gas inlet portion 65, and then the fixing screw 84 is engaged with the screw groove 6*b* through the screw through hole 83, so that the combustion gas guide member 80 is fixed to the combustion gas inlet portion 65 of the fixing member 60.

At this time, the guide key 85*a* formed at one side of the assembling protrusion 85 of the combustion gas inlet member 80 is arranged with the key guide groove 65*d* of the combustion gas inlet portion 65, and the combustion gas inlet 81*a* of the combustion gas inlet hole 81 is formed in the forward direction, and the inner end of the same is accurately aligned with the combustion gas inlet hole 65*a*.

An O-ring 86 is inserted between the outer surface of the combustion gas inlet portion 65 and the flange portion 82 of the combustion gas inlet member 80. Here, the O-ring 86 is accurately inserted in such a manner that the O-ring 86 is inserted into the O-ring grooves 65*e* and 87 formed at a portion around the combustion gas inlet hole 65*a* of the combustion gas inlet portion 65 and at the flange portion 82 of the combustion gas guide member 80.

Next, in a state that the rigid sphere 50, which is inserted in such a manner that the front surface of the rear end expanding portion 44 of the operation piston 40 closely contacts with the rear end surface of the operation cylinder 30, is not protruded from the outer surface of the operation cylinder 30, the assembled structure(as shown in FIG. 4B) of the missile side restraining and releasing member is inserted into the piston operation space 71 of the fixing cylinder 70, so that a part of the rigid sphere 50 is inserted into the restraining groove 72 of the fixing cylinder 70 as shown in FIGS. 4A and 5.

At this time, the operation piston 40 is moved back to the position corresponding to the rigid sphere hole 35 of the operation cylinder 30 by the elastic member 45, and the rigid sphere 50 is moved by the restraining operation portion 41, and a part of the rigid sphere 50 is inserted into the rigid sphere restraining groove 72 of the fixing cylinder 70 in a state that the rigid sphere 50 is protruded from the outer surface of the operation cylinder 30 in the rigid sphere hole 35.

As shown in FIGS. 4A and 5, the combustion gas guide member 90 is inserted into the interior of the combustion gas inlet portion 65.

At this time, the guide key 92 formed at the combustion gas guide member 90 is aligned with the key guide groove 65*f* formed on the inner surface of the combustion gas inlet portion 65, and one end of the combustion gas guide hole 91 of the combustion gas guide member 90 is accurately aligned with the combustion gas inlet hole 65*a*, so that another end of the combustion gas guide hole 91 is formed in the interior of the combustion gas inlet port 65 in the forward direction.

The combustion gas guide member 90 may be tightly inserted into the interior of the combustion gas inlet portion 65. Preferably, the same is fixed by engaging the final fixing member 100 to the rear end portion of the combustion gas inlet portion 65 as shown in FIGS. 4A through 5.

The final fixing member 100 is engaged in such a manner that the threaded portion 101 formed on the inner surface is engaged with the threaded portion 65*g* formed at the rear end portion of the combustion gas inlet portion 65.

At this time, the combustion gas flown into the restraining and releasing operation portion 91 through the combustion gas inlet hole 81, the combustion gas inlet hole 65*a*, and the combustion guide hole 91 is not leaked by inserting the O-ring 102 between the read end surface of the combustion gas inlet portion 65 and the front surface of the final fixing member 100.

The O-ring 102 is inserted into the O-ring grooves 65*h* and 103 formed on the rear end surface of the combustion gas inlet portion 65 and the front surface of the final fixing member 100.

The fixing member 60, in which the fixing cylinder 70, the combustion gas inlet member 80, the combustion gas guide member 90, and the final fixing member 100 are assembled, is engaged with the screw groove 66*a* of the fixing portion 66 by passing the fixing screw 22 through the screw through hole 21 in a state that the fixing portion 66 closely contacts with the inner surface of the canister 20.

At this time, the O-ring 68 is inserted between the inner surface of the canister 20 and the fixing portion 66, so that the combustion gas in the canister 20 is not leaked through the outer wall of the canister 20. The O-ring 68 may be accurately inserted therebetween by inserting the O-ring 68 into the O-ring groove 66*b* formed at the fixing portion 66.

When assembling the above-described elements, the operation cylinder 30 and the operation piston 40 which form the missile side restraining and releasing member are first assembled, and then the fixing member 60, the fixing cylinder 70, the combustion gas inlet member 80, the combustion gas guide member 90, and the final fixing member 100 which form the canister side restraining and releasing member are sequentially assembled for thereby implementing a quick and easy assembling process.

As shown in FIGS. 4A and 5, in a state that the assembly is completed, in the side of the missile 10, the operation cylinder 30 and the operation piston 40 are engaged, and in the side of the canister tube 20, the operation cylinder 30 is inserted into the interior of the fixing cylinder 70 fixed to the fixing cylinder fixing portion 63 of the fixing member 60 in a state that the fixing member 60, in which the fixing cylinder 70, the combustion gas inlet member 80, the combustion gas guide member 90, and the final fixing member 100 are assembled, is fixed, and the restraining protrusion 12 of the missile 10 is inserted into the missile restraining portion 62 of the fixing member 60.

Therefore, the rigid sphere 50 protruded from the outer surface of the operation cylinder 30 is inserted into the rigid sphere restraining groove 62 of the fixing cylinder 70, and the missile 10 and the canister 20 are stably restrained by the combined operations of the operation cylinder 30, the operation piston, the rigid sphere 50, the fixing member 60, and the fixing cylinder 70.

Since the rigid sphere 50 is positioned in the rigid sphere hole 35 of the operation cylinder 30, and a predetermined portion of the rigid sphere 50 is positioned in the rigid sphere restraining groove 62 of the fixing cylinder 70, the rigid sphere 50 is supported by the restraining operation portion 41 of the operation cylinder 40 for thereby obtaining a predetermined restraining force of the missile 10 against the canister 20.

In the operation piston 40, the rear end surface of the rear end expanding portion 44 closely contacts with the front surface of the combustion gas guide member 90.

In this state, the motor portion of the missile 10 is ignited, and the combustion gas is projected from the nozzle portion 11. This combustion gas is flown into the combustion gas inlet hole 81 through the combustion gas inlet 81*a* of the combustion gas inlet member 80, and the combustion gas flown into the combustion gas inlet hole 81 is flown into the combustion gas guide hole 91 of the combustion gas guide member 90 through the combustion gas inlet hole 65*a*, and the combustion gas flown into the combustion gas guide hole 91 is guided toward the rear end surface of the rear end expanding portion 44 of the operation piston 40 by the combustion gas guide hole 91.

Therefore, as shown in FIG. 4*a*, the operation piston 40 is forwardly moved by the pressure of the combustion gas against the elastic force of the elastic member 45, and when the restraining release operation groove 43 reaches the position of the rigid sphere hole 35 of the operation cylinder 30, since the restraining force of the restraining operation portion 41 of the operation piston which supports the rigid sphere 50 is removed, the rigid sphere 50 assumes a free state. At this time, since the outer surface of the operation piston 40 which is moving toward the front side of the missile together with the missile by the rocketing force of the missile pushes the center upper portion of the rigid sphere 50, the rigid sphere 50 is moved toward the restraining release operation groove 43, and the restraining state is released. Namely, assuming that the diameter of the rigid sphere is D, the thickness of the wall 32 of the operation cylinder 30 is t, and the depth of the restraining release operation groove 43 is d, $D \leqq t+d$. Therefore, the rigid sphere 50 is not protruded from the outer surface of the operation cylinder 30. Namely, the rigid sphere 50 is gradually escaped from the rigid sphere restraining groove 62.

In this state, when the restrained state is released, the missile 10 is moved, and the restraining protrusion 12 of the missile 10 is escaped from the missile restraining portion 62 of the restraining and releasing operation portion 61 of the fixing member 60, and at the same time, the operation piston 40 and the operation cylinder 30 are escaped from the fixing cylinder 70, so that the missile 10 is launched from the canister 20 in a state that the missile 10 is engaged with the operation cylinder 30.

As described above, in the apparatus for restraining and releasing a missile according to the present invention, the missile is stabled restrained in the canister. When launching the missile, the restrained state of the missile is quickly and accurately released by a small force of the projecting force of the missile, so that it is possible to stably and accurately launch the missile. In addition, in the present invention, since any impact and vibration do not occur when releasing the restrained state of the missile, it is possible to increase a stability of the launch of the missile for thereby significantly decreasing the launching error. In addition, when assembling the missile into the canister for restraining the missile, the missile is easily assembled in the direction of the rear side of the same for thereby implementing an easy assembling.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An apparatus for restraining and releasing a missile, comprising:

a pair of circular restraining protrusions formed at a rear end portion of a missile nozzle portion;

a missile side restraining and releasing means having:

an operation cylinder engaged to a rear end surface of the restraining protrusion of the missile;

an operation piston reciprocating within the operation cylinder; and a rigid sphere protruded from an outer surface of the operation cylinder when the operation piston is moved back and inserted into the outer surface of the operation cylinder when the operation piston is moved forwardly;

a canister(launch tube) side restraining and releasing means having:

a missile restraining portion fixed to the inner surface of the rear end portion of the canister into which the missile is inserted, with the circular restraining protrusion being inserted into the missile restraining portion;

a fixing cylinder fixing portion into which the rigid sphere protruded from the outer surface of the operation cylinder is inserted; and a piston guide portion for guiding the rear end portion of the operation piston; and a combustion gas guide means for guiding a part of a combustion gas generated when launching the missile toward the rear end portion of the operation piston for thereby moving the operation piston forwardly, so that the rigid sphere is escaped from the rigid sphere restraining groove for thereby releasing the restrained state of the missile.

2. The apparatus of claim 1, wherein said missile side restraining and releasing means includes:

an operation cylinder having a piston operation space engaged with the rear end surface of the restraining protrusion and having its opened rear end, and a rigid sphere hole, into which the rigid sphere is inserted, formed on a wall; and an operation piston reciprocating within the piston operation space of the operation cylinder and having a restraining operation portion by which a part of the rigid sphere is protruded from an outer surface in the rigid sphere hole when the operation piston is moved back, and a restraining release operation groove by which the remaining parts of the rigid sphere are inserted into the rigid sphere hole when the operation piston is moved forwardly.

3. The apparatus of claim 2, wherein said operation piston is integrally engaged with the guide portion extended from the opposite of the restraining operation portion about the restraining release operation groove, slidably contacting with the inner surface of the piston operation space of the operation cylinder and guiding the backward movement of the operation piston.

4. The apparatus of claim 2, wherein a rear end portion of the operation piston is integrally formed with a rear end expanding portion for maximizing the pressure of the combustion gas guided by the combustion gas guide means.

5. The apparatus of claim 2, wherein assuming that the diameter of the rigid sphere is D, the thickness of the wall of the operation cylinder is t, the depth of the restraining release operation groove is d, and the depth of the rigid sphere groove of the fixing cylinder is d', the following expression is obtained:

$$D \leq t+d,\ D=t+d',\ D/2<t \text{ and } D/2>d$$

6. The apparatus of claim 2, wherein said rigid sphere is supported by the outer surface of the operation cylinder in such a manner that the center of the rigid sphere is position in the rigid sphere hole of the operation cylinder, and the half portions of the rigid sphere is positioned in the rigid restraining groove of the fixing cylinder, for thereby providing a restraining force of the missile with respect to the canister.

7. The apparatus of claim 2, wherein said operation cylinder includes a threaded rod formed extended from the front wall, whereby the missile is fixed by engaging the threaded rod to the restraining screw groove formed at the restraining protrusion of the missile.

8. The apparatus of claim 7, wherein a tool groove is formed on an inner surface of the front wall of the operation cylinder for engaging the threaded rod to the screw groove.

9. The apparatus of claim 1, wherein said canister side restraining and releasing means includes:

a fixing member having a restraining and operation portion fixed to the inner surface of the canister and having a missile restraining portion, a fixing cylinder fixing portion, and a piston guide portion; and a fixing cylinder inserted into the interior of the fixing cylinder fixing portion and having an operation space through which the operation cylinder and the operation piston pass through and a rigid sphere restraining groove formed on an inner surface of the operation space and inserted into the rigid sphere.

10. The apparatus of claim 9, wherein a combustion gas inlet portion having a combustion gas inlet hole formed on the wall is integrally formed with the rear end portion of the piston guide portion of the fixing member.

11. The apparatus of claim 9, wherein a plurality of screw grooves are formed at the fixing portion integrally formed with the restraining and releasing operation portion, and said fixing member is fixed to the canister in such a manner that the fixing screw is engaged to the threaded groove through the screw through hole formed on the wall of the canister.

12. The apparatus of claim 11, wherein an O-ring is inserted between the fixing portion and the inner surface of the canister.

13. The apparatus of claim 11, wherein an O-ring groove is formed around the screw groove of the fixing portion for inserting the O-ring thereinto.

14. The apparatus of claim 1, wherein said combustion gas guide means includes:

a combustion gas inlet member engaged to an outer surface of the combustion gas inlet portion for introducing the combustion gas generated when launching the missile into the combustion gas inlet hole; and a combustion gas guide member inserted into the interior of the combustion gas inlet portion for guiding the combustion gas flown into the combustion gas inlet portion to the rear end expanding portion of the operation piston.

15. The apparatus of claim 14, wherein said combustion gas inlet member includes:

a combustion gas inlet hole having its outer end portion formed in the forward direction, and its inner end aligned with the outer terminal of the combustion gas inlet hole, and said combustion gas guide member having its outer end aligned with the inner end of the combustion gas inlet hole, and its inner end formed in the direction of the rear end expanding portion of the operation piston.

16. The apparatus of claim 15, wherein said combustion gas inlet member includes an integrally formed flange portion having an assembling protrusion and a screw through hole, whereby the assembling protrusion is inserted into the assembling groove formed on the outer surface of the combustion gas inlet portion, and the fixing screw is engaged with the screw groove formed on the outer surface of the combustion gas inlet portion through the screw through hole in a state that the flange portion closely contacts with the outer surface of the combustion gas inlet portion.

17. The apparatus of claim 16, wherein a guide key is formed at one side of the assembling protrusion, and a key guide groove, which corresponds to the guide key, formed at one side of the assembling groove, for thereby implementing an accurate assembling direction of the combustion gas inlet member.

18. The apparatus of claim 15, wherein an O-ring is inserted between the outer surface of the combustion gas inlet portion and the flange portion of the combustion gas inlet member.

19. The apparatus of claim 18, wherein said O-ring groove is formed around th e combustion gas inlet hole of the combustion gas inlet portion and abound the inner end portion of the combustion gas inlet hole of the combustion gas inlet member for thereby inserting the O-ring into the O-ring groove.

20. The apparatus of claim 14, wherein said combustion gas guide member is inserted into the interior of the combustion gas inlet portion and includes a combustion gas guide hole having its outer end aligned with the inner end of the combustion gas inlet hole and its inner end formed in the direction of the rear end expanding portion of the operation piston.

21. The apparatus of claim 20, wherein a guide key is formed on an outer surface of the combustion gas guide member, and a key guide groove, which corresponds to the guide key, is formed on an inner surface of the combustion gas inlet portion for thereby implementing an accurate assembling direction of the combustion gas guide member.

22. The apparatus of claim 20, wherein said combustion gas guide member is fixed in such a manner that the threaded portion formed on the rear end portion of the combustion gas inlet portion is engaged with the threaded portion of the final fixing member for thereby preventing the combustion gas guide member from moving toward the read end of the combustion gas inlet portion.

23. The apparatus of claim 22, wherein an O-ring is inserted between the rear end surface of the combustion gas inlet portion and the front surface of the final fixing member.

24. The apparatus of claim 23, wherein an O-ring groove is formed on the rear end surface of the combustion gas inlet portion and on the front surface of the final fixing member for thereby inserting the O-ring into the O-ring groove.

* * * * *

UNITED STATES PATENT AND TRADEMARK OFFICE

CERTIFICATE OF CORRECTION

PATENT NO. : 6,286,409 B1
DATED : September 11, 2001
INVENTOR(S) : M. Na et al.

It is certified that error appears in the above-identified patent and that said Letters Patent is hereby corrected as shown below:

Column 4,
Lines 13 & 14, "hole are" should read -- hole 35 are --

Column 5,
Line 55, "Th" should read -- The --

Column 8,
Line 11, "31 a" should read -- 31*a* --

Column 9,
Line 46, "read" should read -- rear --

Column 14,
Line 11, "th e" should read -- the --
Line 35, "read" should read -- rear --

Signed and Sealed this

Twenty-second Day of October, 2002

*Attest:*

*Attesting Officer*

JAMES E. ROGAN
*Director of the United States Patent and Trademark Office*